US009926045B1

(12) United States Patent
Ostmeyer et al.

(10) Patent No.: US 9,926,045 B1
(45) Date of Patent: Mar. 27, 2018

(54) FOLDING SUN COVER

(71) Applicant: Xtreme Marine Corporation, Maryville, TN (US)

(72) Inventors: Matthew Ostmeyer, Maryville, TN (US); Robert Metcalf, Loudon, TN (US); Jim Wilson, Loudon, TN (US); Mike Howard, Loudon, TN (US); Mike Hawk, Philadelphia, TN (US)

(73) Assignee: Xtreme Marine Corporation, Maryville, TN (US)

( * ) Notice: Subject to any disclaimer, the term of this patent is extended or adjusted under 35 U.S.C. 154(b) by 0 days.

(21) Appl. No.: 15/262,444

(22) Filed: Sep. 12, 2016

Related U.S. Application Data

(60) Provisional application No. 62/218,180, filed on Sep. 14, 2015.

(51) Int. Cl.
*B63B 17/00* (2006.01)
*B63B 17/02* (2006.01)

(52) U.S. Cl.
CPC ..... *B63B 17/02* (2013.01); *B63B 2017/026* (2013.01)

(58) Field of Classification Search
CPC ... B63B 17/023; B63B 17/02; B63B 2017/02; B63B 2017/026
USPC ..... 114/343, 361; 248/514
See application file for complete search history.

(56) References Cited

U.S. PATENT DOCUMENTS

| | | | | |
|---|---|---|---|---|
| 2,689,579 | A * | 9/1954 | Sartori | B63B 17/02 135/133 |
| 4,926,782 | A | 5/1990 | Lacy | |
| 5,918,613 | A | 7/1999 | Larson | |
| 6,026,761 | A | 2/2000 | Parniske et al. | |
| 6,209,477 | B1 | 4/2001 | Biedenweg | |
| 6,257,261 | B1 | 7/2001 | Johnson | |
| 6,327,993 | B1 | 12/2001 | Richens | |
| 6,666,159 | B2 | 12/2003 | Larson | |
| 6,691,637 | B1 | 2/2004 | Smith | |
| 6,755,332 | B2 | 6/2004 | Crane | |
| 6,799,529 | B1 | 10/2004 | Willis | |
| 6,945,188 | B2 | 9/2005 | Eck | |
| 6,983,716 | B1 | 1/2006 | Ankney et al. | |
| 7,013,830 | B1 | 3/2006 | Willis | |
| 7,392,758 | B2 | 7/2008 | Metcalf | |
| 7,418,918 | B2 | 9/2008 | Bierbower et al. | |
| 7,438,015 | B1 | 10/2008 | Schwindaman | |
| 7,798,089 | B2 | 9/2010 | McKeand | |
| 7,895,964 | B2 | 3/2011 | Russikoff | |
| 7,950,342 | B2 | 5/2011 | Russikoff | |
| 8,025,194 | B2 | 9/2011 | Jesewitz | |
| 8,297,484 | B2 | 10/2012 | Jesewitz | |
| 8,567,651 | B2 | 10/2013 | Jesewitz | |
| 8,752,498 | B1 | 6/2014 | Schwindaman et al. | |

(Continued)

*Primary Examiner* — Daniel V Venne
(74) *Attorney, Agent, or Firm* — Luedeka Neely Group, PC

(57) ABSTRACT

A foldable sun cover mountable on a watersports tower of a boat. The sun cover includes a pair of frames connected to a pair of hubs mounted on opposite sides of the tower, each hub having a pair of movable mounts. Each of the movable mounts is connected to one of the frames and independently movable to orient the frames each to a locked and deployed position in which each frame is locked in a substantially horizontal position so that each frame is substantially aligned with and parallel to the other frame.

8 Claims, 8 Drawing Sheets

(56) References Cited

U.S. PATENT DOCUMENTS

| | | | |
|---|---|---|---|
| 2005/0194414 | A1 | 9/2005 | Lynch |
| 2012/0067269 | A1 | 3/2012 | Williams |
| 2014/0261143 | A1 | 9/2014 | Williams et al. |
| 2014/0261144 | A1 | 9/2014 | Nemeth |

* cited by examiner

FOLDING SUN COVER

CROSS-REFERENCE TO RELATED APPLICATION

This application claims priority to U.S. Provisional Application Ser. No. 62/218,180 filed Sep. 14, 2015, entitled FOLDING SUN COVER, and incorporated by reference herein in its entirety.

FIELD

The present disclosure relates to sun covers for boats. More particularly, the disclosure relates to a sun cover of folding construction configured to mount on a watersports tower.

BACKGROUND

Improvement is desired in the provision of sun covers for boats. In particular, what is desired is a folding sun cover mountable on a watersports tower structure that is quick and easy to deploy and to take down and store.

Sun covers according to the disclosure are lightweight and easily deployed and stowed for storage. The sun covers are advantageously configured to quickly deploy and to automatically lock in place when oriented in a deployed position. This is especially advantageous when deploying the sun cover in windy conditions.

SUMMARY

The present disclosure provides a folding sun cover mountable on a watersports tower structure.

In one aspect, the sun cover includes a pair of frames connected to a pair of hubs mounted on opposite sides of the tower, each hub having a pair of movable mounts. Each of the movable mounts is connected to one of the frames and independently movable to orient the frames each to a locked and deployed position in which each frame is locked in a substantially horizontal position so that each frame is substantially aligned with and parallel to the other frame.

In another aspect, the sun cover includes a pair of frames connected to a pair of hubs mounted on opposite sides of the tower. Each hub includes a rotatable drive member drivingly engaged with a first rotatable plate and a first movable mount connected to one of the frames. Rotation of the drive member directly rotates the first plate and the first movable mount.

Each hub also includes a first lock surface located on the first plate and a first spring loaded lock operatively associated with the first plate. When the first plate is rotated such that the first lock surface is aligned with the first spring loaded lock, the first lock engages the first lock surface to lock the first rotatable plate against rotation.

Each hub further includes a second movable mount connected to the other of the frames and directly connected to a second plate, the second plate being independently rotatable about the rotatable drive member; and a second lock surface located on the second plate and a second spring loaded lock operatively associated with the second plate. When the second plate is rotated such that the second lock surface is aligned with the second spring loaded lock, the lock engages the second lock surface to lock the second rotatable plate against rotation.

The disclosure also relates to a hub for rotatably mounting a pair of frame members.

In one aspect, the hub includes a rotatable drive member drivingly engaged with a first rotatable plate and a first movable mount connectable to one of the frames. Rotation of the drive member directly rotates the first plate and the first movable mount.

The hub also includes a first lock surface located on the first plate and a first spring loaded lock operatively associated with the first plate. When the first plate is rotated such that the first lock surface is aligned with the first spring loaded lock, the first lock engages the first lock surface to lock the first rotatable plate against rotation.

The hub also includes a second movable mount connectable to the other of the frame members and connected to a second plate, the second plate being independently rotatable about the rotatable drive member.

A second lock surface is located on the second plate and a second spring loaded lock operatively associated with the second plate. When the second plate is rotated such that the second lock surface is aligned with the second spring loaded lock, the lock engages the second lock surface to lock the second rotatable plate against rotation.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
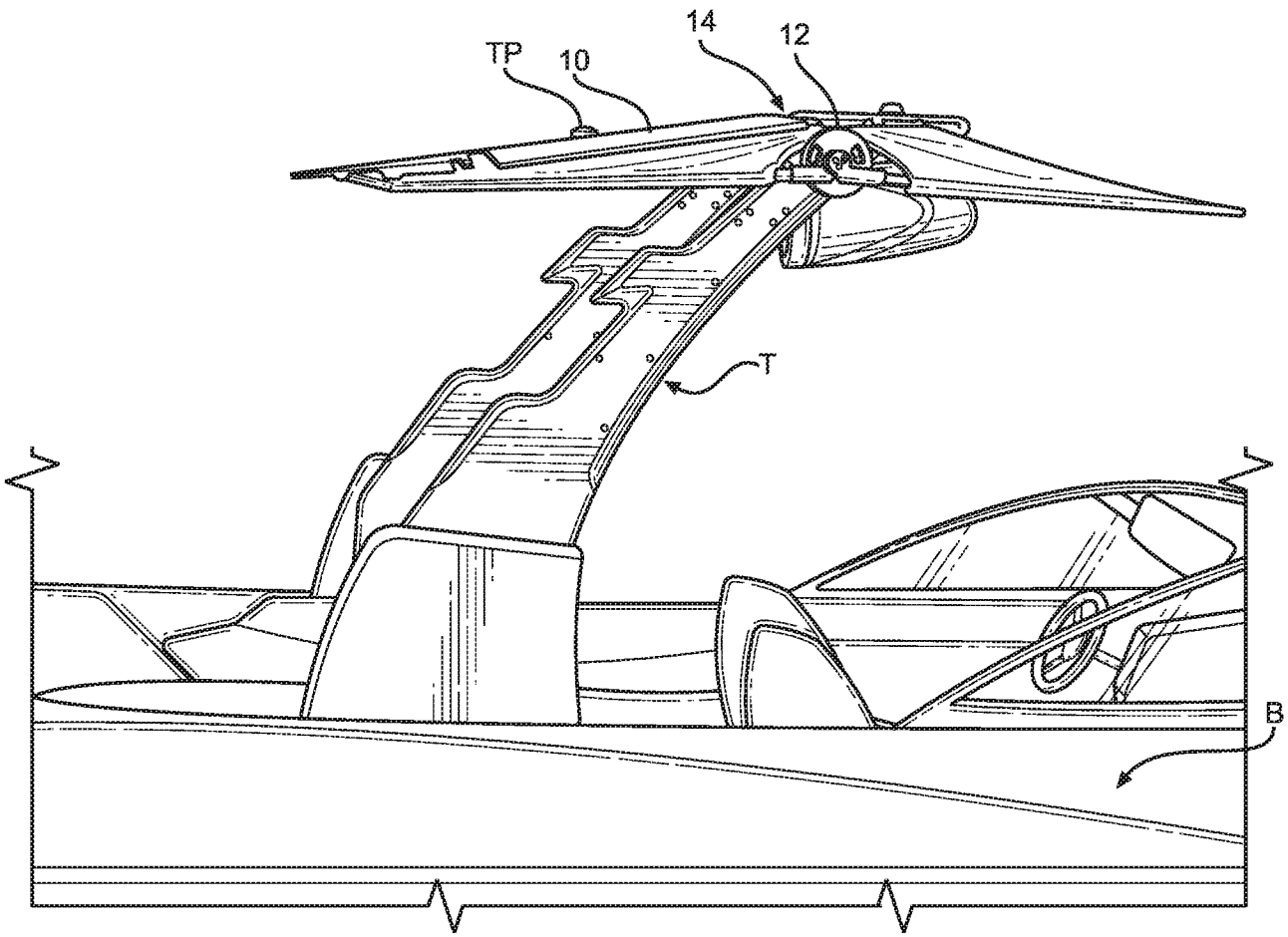
FIGS. 1-5 show a folding sun cover according to the disclosure mounted to a folding water sports tower, and showing operation of the folding sun cover.

With reference to the drawings, there is shown a foldable sun cover 10 according to the disclosure that is mountable on a watersports tower T located on a boat B having a windshield W. The tower T may be a fixed tower or a folding tower and includes a light L as well as a tow point TP.

The foldable sun cover 10 includes a starboard hub 12 and a port hub 14 which enable desired folding. The starboard hub 12 is mounted to the starboard side of the tower T, and the port hub 14 is mounted to the port side of the tower T. The hubs 12 and 14 are of the same construction, except being mirror images in that the hub 12 is configured for location on the starboard side and the hub 14 is configured for location on the port side.

The sun cover 10 further includes a sun cover frame 16 connected and a sun cover frame 18. The frames 16 and 18 each connect to the hubs 12 and 14 on opposite sides of the tower T, so as to be foldable as depicted in the FIGS. 2-5.

A flexible sun cover material 20 is attachable to the frame 16 and the frame 18, as by mating hook and loop material or other fasteners. The cover material 20 is configured to have a slit or other opening for passage of the tow point TP of the tower T so as to enable the sun cover 10 to be deployed as a sun cover while use of the tow point TP. Likewise, a slit of the like is provided for the light L. The frames 16 and 18 may be made of tubular aluminum or the like, and each is preferably u-shaped. The sun cover material may be a fabric or the like suitable for serving as a sun cover for a boat.

The hubs 12 and 14 are configured so that the frames 16 and 18 automatically lock in place when oriented in a deployed position. For example, FIG. 1 shows both of the frames 16 and 18 in their respective deployed positions to provide full coverage for the sun cover 10. As seen, in this position the frames 16 and 18 are horizontally oriented and opposed to one another.

Figure 2:
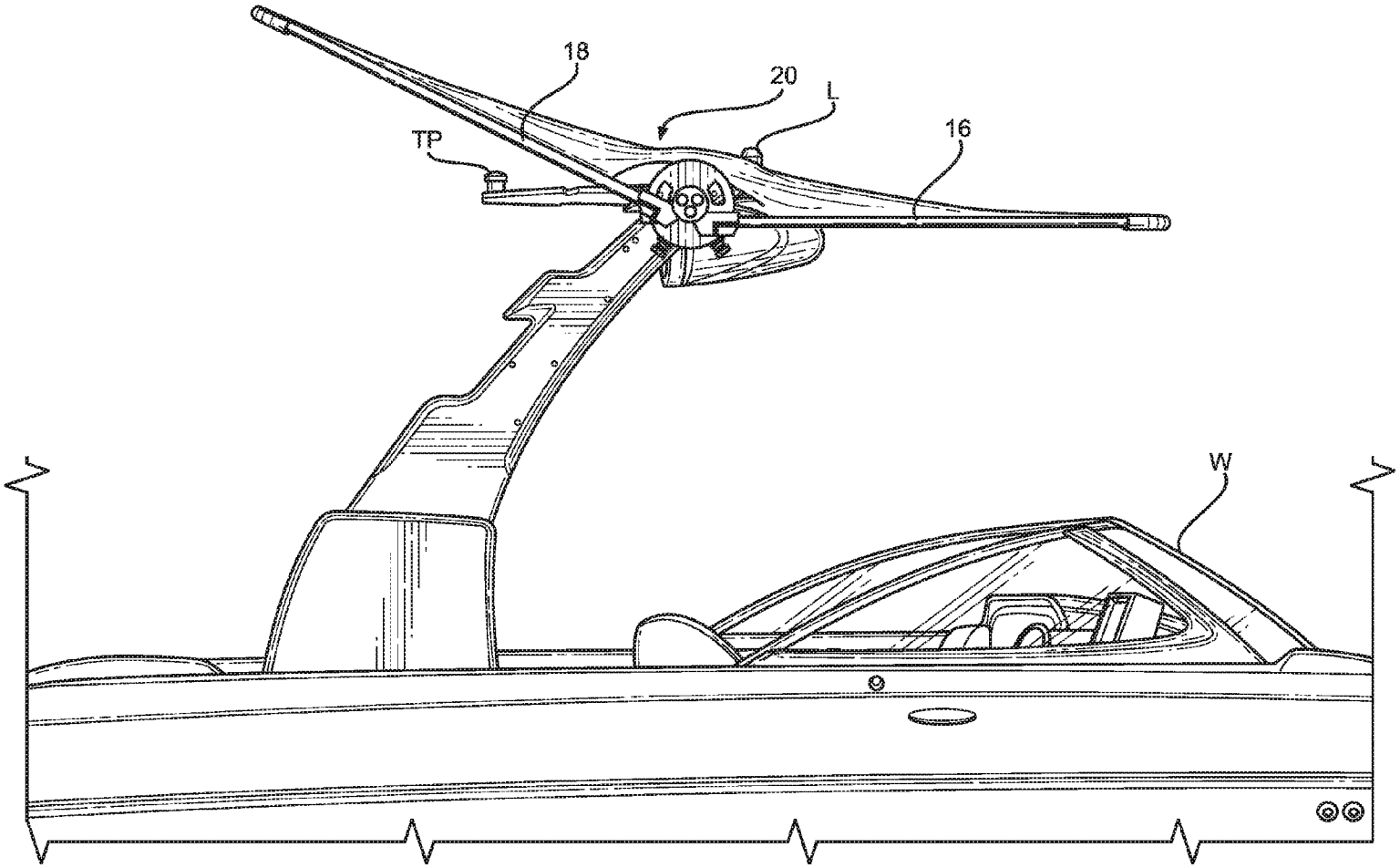
Figure 3:
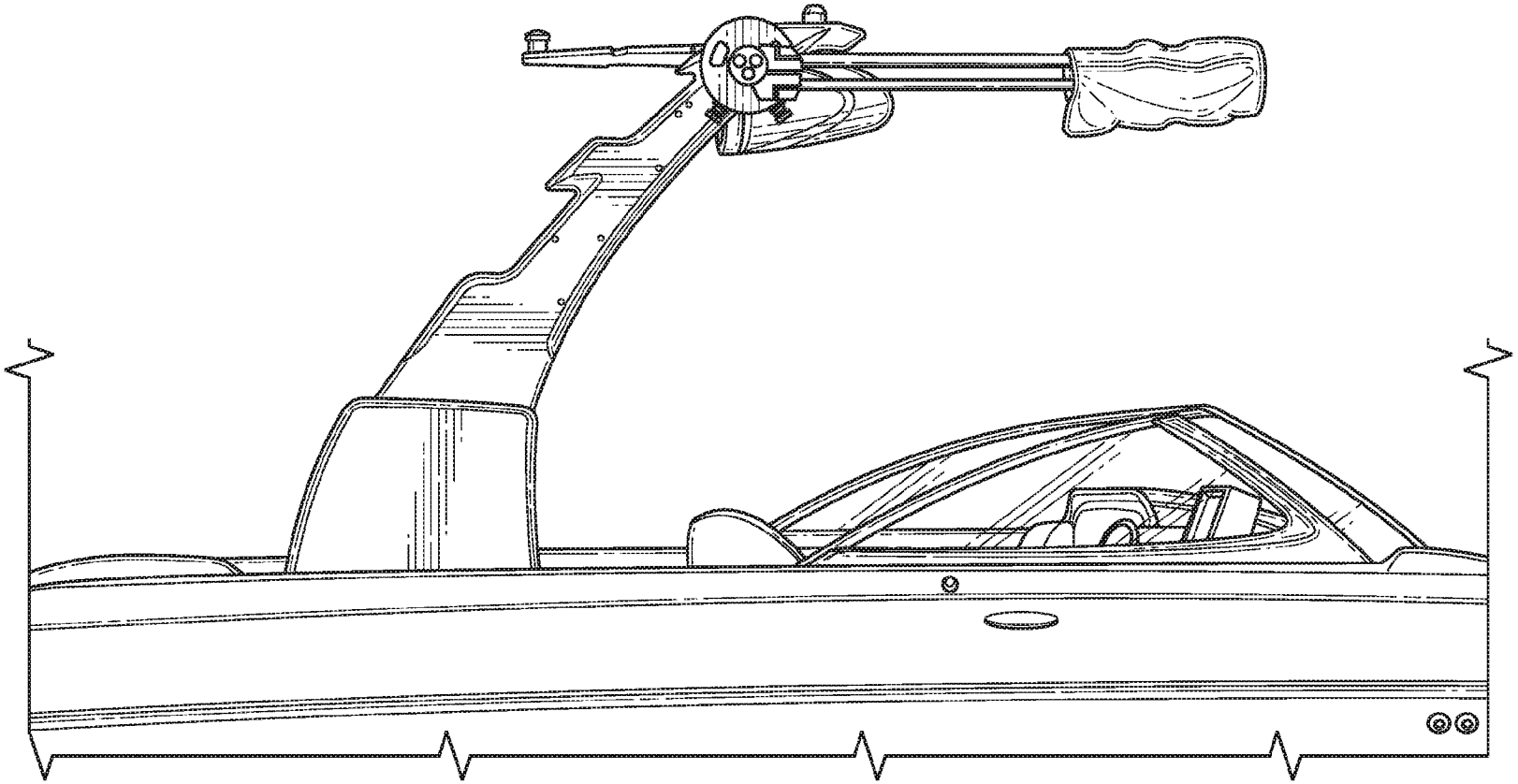
Figure 4:
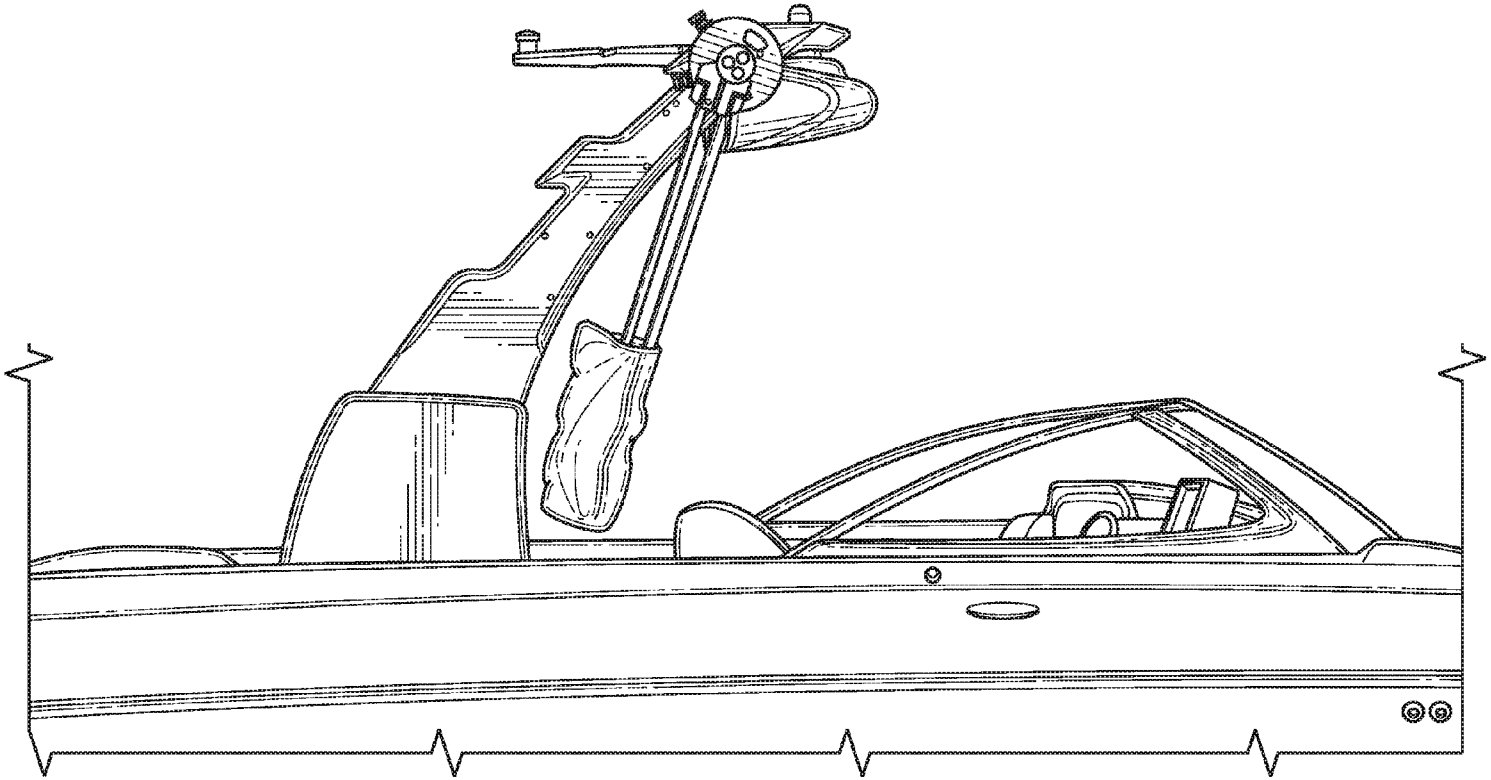
Figure 5:
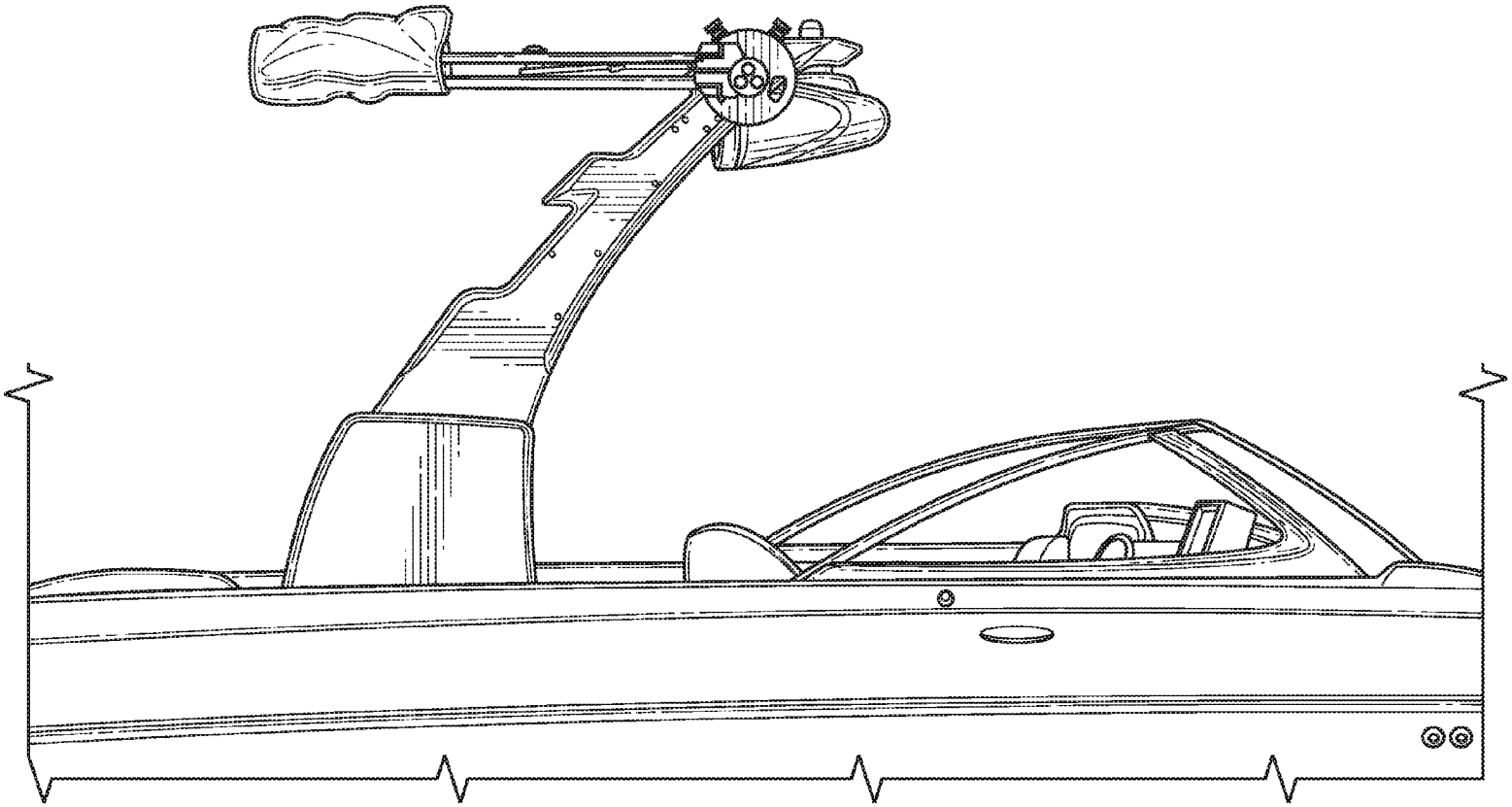

FIG. 2 shows only the frame 16 in the deployed and locked position, with the frame 18 being rotated toward the frame 16. FIG. 3 shows the frame 16 in the locked and deployed position, with the frame 18 secured thereto as by a strap and storage shroud. FIG. 4 shows the frames 16 and 18 fully rotated clockwise for storage of the sun cover 10 against the tower T. In this orientation, both of the frames 16 and 18 are in a locked storage position. FIG. 5 shows a storage position in which the frame 18 is in its locked and deployed position, and the frame 16 is rotated to so that the frame 16 overlies the frame 18, with a storage shroud therearound.

Accordingly, it will be appreciated that the foldable sun cover 10 is configured to provide quick and easy deployment and stowage. As depicted, the sun cover 10 may be stowed with the tower T, and may be stored either forward or aft in the boat B. Also, the cover 10 may travel with the tower T as it is folded if the tower is foldable. For example, with the frames 16 and 18 oriented as shown in FIG. 4, the tower T, if foldable, may be folded forward and the cover 10 will be out of the way below the tower T.

Figure 6:
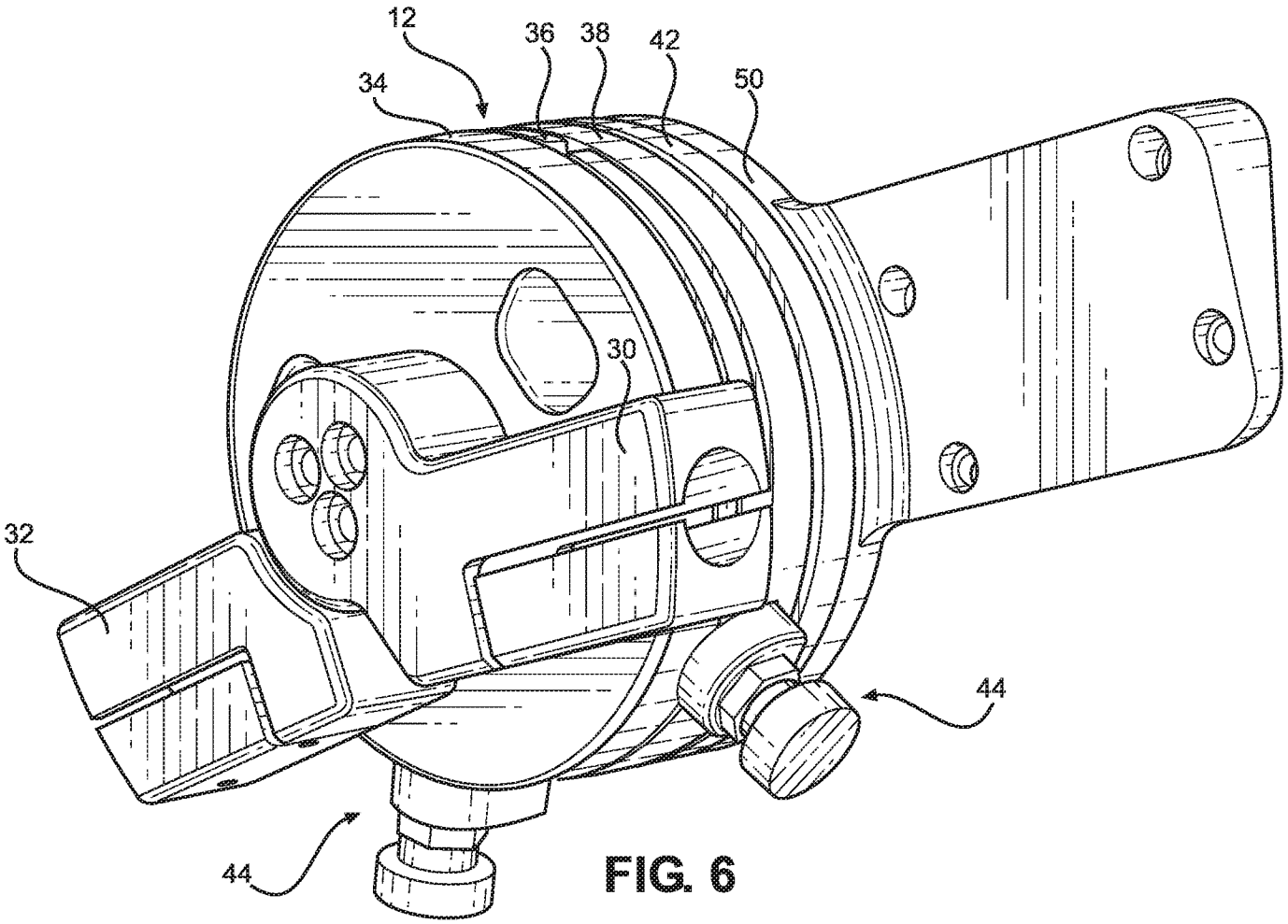
FIGS. 6-7 show assembled views of a starboard side hub of a folding sun cover according to the disclosure.
Figure 7:
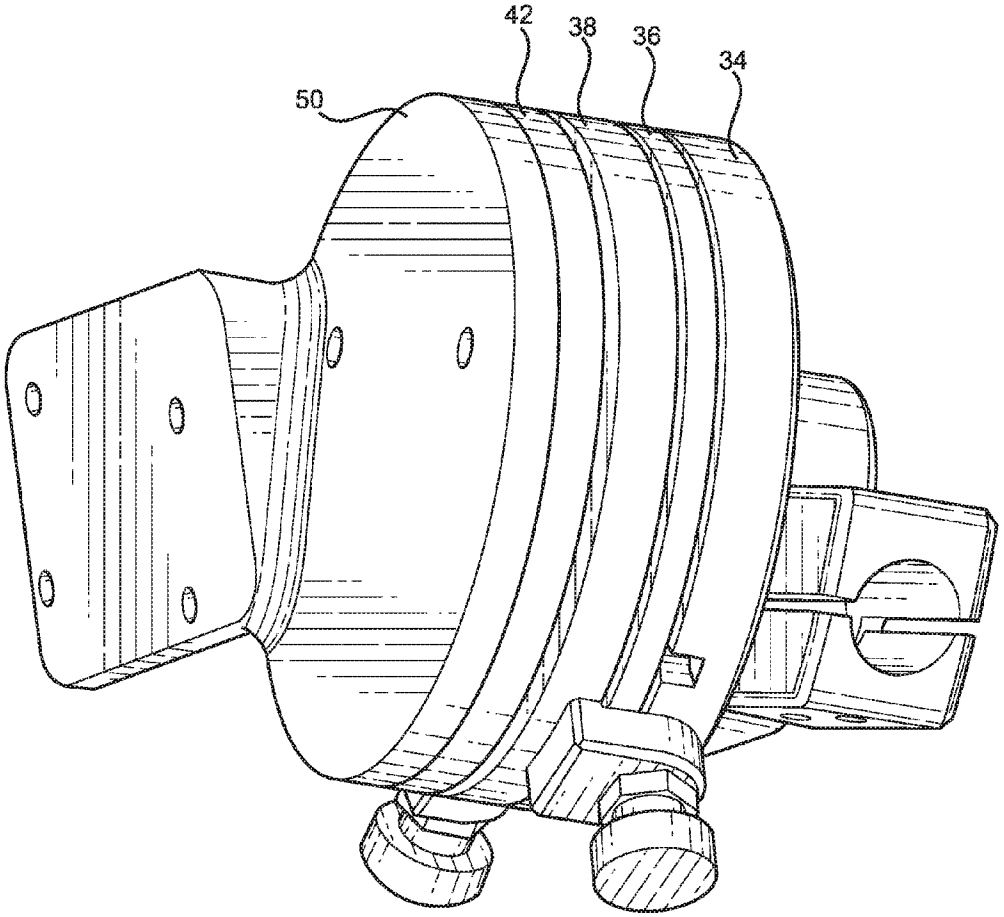
Figure 8:
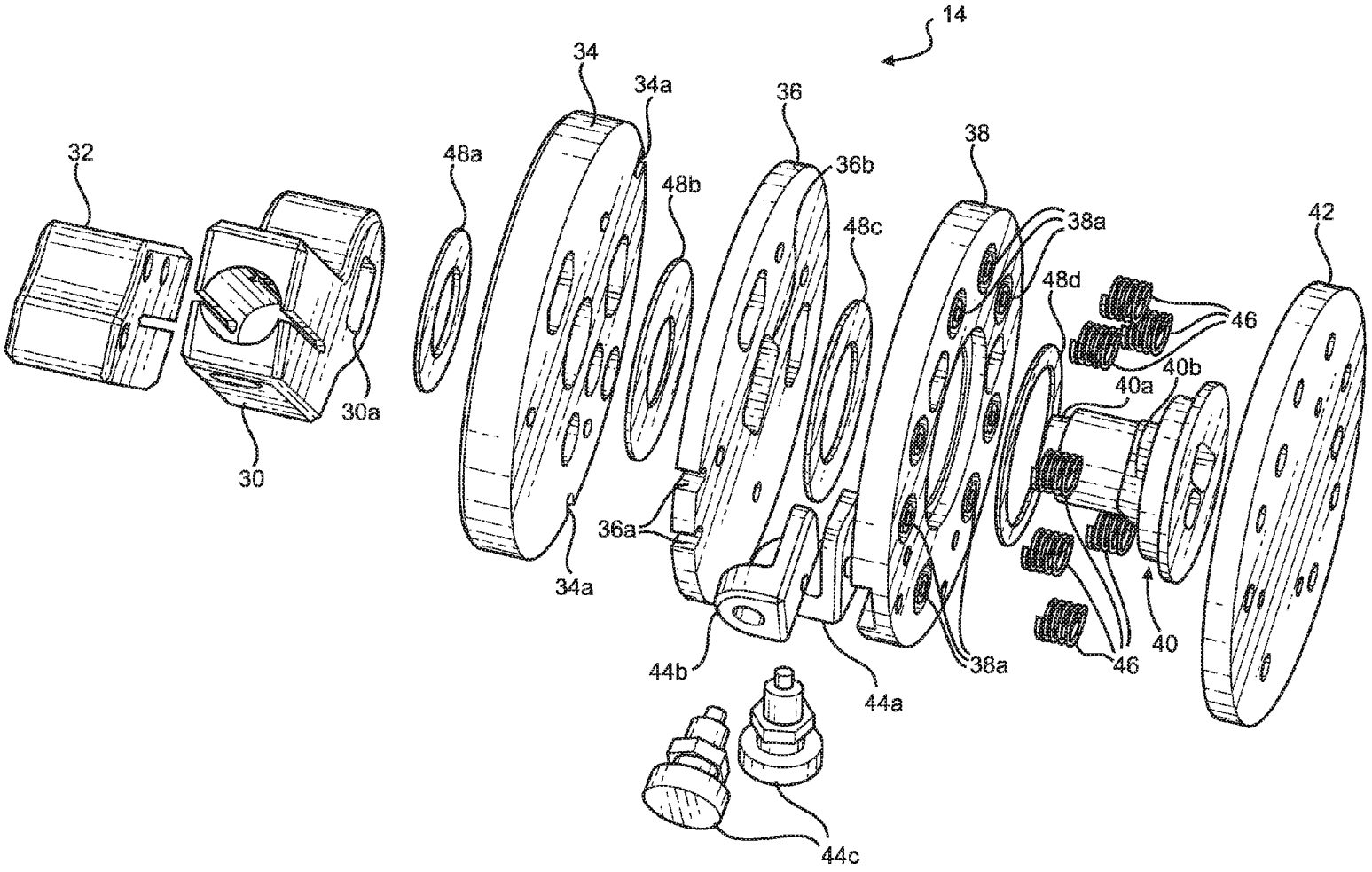
FIG. 8 is an exploded view of a port side hub of a folding sun cover according to the disclosure.

With reference to FIGS. 6-7, the hub 12 is shown assembled. With reference to FIG. 8, there is shown an exploded view of the port side hub 14. The hub 12 and the hub 14 are identical, except for being configured for placement on opposite sides of the tower T.

The hubs 12 and 14 may be of metal construction and each include a movable frame mount 30, a movable frame mount 32, a front index plate 34 having indexing slots 34*a*, a rear index plate 36 having indexing slots 36*a*, a base plate 38, a drive member or drive puck 40, and a mounting plate 42. The drive puck 40 is preferably made of stainless steel.

The frame mount 30 has a square aperture 30*a* that is mounted to a square drive end 40*a* of the drive puck 40, which directly drives the rear index plate 36 via a square drive surface 40*b* of the puck 40 that mates with a square drive aperture 36*b* of the rear index plate 36. The puck 40 serves as the pivoting point for all components and drives the rear index plate 36 and the outer tube mount 30. All other moving parts are independently moving around puck 40. The frame mount 32 is mounted to the front index plate 34 and moves in rotation with the front index plate 34. The index plate 34 moves independently around the puck 40.

A pair of spring plunger locks 44, provided by brackets 44*a* and 44*b*, each having a plunger 44*c*, are mounted to the base plate 38. One of the plunger locks 44 cooperates with the front index plate 36 and the other plunger lock 44 cooperates with the rear index plate 36. The indexing slots 34*a* and 36*a*, of the index plates 34 and 36, determine locked positions for the frame mounts 30 and 32. It will be appreciated that the number and positions of the indexing slots may be selected to provide desired locked locations.

A plurality of compression springs 46 are fit into receivers 38*a* on the back of the base plate 38, between the base plate 38 and the mounting plate 40, surrounding the drive puck 40. The compression springs 46 are designed to absorb any inconsistencies on boat towers. In this regard, for the hubs 12 and 14 to work properly, they need to remain substantially parallel during the entire range of motion. The springs 46 are configured to allow for up to 3 degree plus or minus variation on the tower T so the hubs can flex to remain parallel to each other regardless if the arms of the tower are parallel to each other, thus allowing for smooth rotation.

Nylon washers 48*a*, 48*b*, 48*c*, and 48*d*, are desirably located between adjacent metal surfaces to reduce metal on metal wear. A mounting bracket 50 secures to the back of the mounting plate 42 for mounting of the hubs to the tower T (shown with hub 12 in FIGS. 6 and 7). The mounting bracket 50 is specific to the model of boat/tower that the hub is designed to fit.

The frame mounts 30 and 32 receive and hold the frames 16 and 18, respectively. The position of the frame mount 30 and the front index plate 34 is locked when the plunger lock 44 associated therewith has the plunger 44*c* thereof seated within one of the indexing slots 34*a*. The position of the frame mount 32 and the rear index plate 36 is locked when the plunger lock 44 associated therewith has the plunger 44*c* thereof seated within one of the indexing slots 36*a*.

The plungers 44*c* are each spring loaded and are received into the desired indexing slots on the index plates while opened or closed. The base plate 38 serves as a holder for the compression springs 46 to allow the hub assembly to compress during assembly. The drive puck 40 drives the hub assembly during the open and closed positions.

In operation of the sun cover 10, the frames 16 and 18 may each be moved independently of one another by unlocking their associated plunger lock 44 and moving the frames as desired to rotate the associated components of the hubs 12 and 14.

To move the frame 16, which is connected to the frame mounts 30 of the hubs 12 and 14, the user unlocks the associated plunger locks 44 and pulls or pushes on the frame 16, which causes the front index plate 34 to rotate. For each hub, once the index plate 34 is rotated to a location where the plunger 44*c* associated therewith encounters one of the indexing slots 34*b*, the plunger 44*c* under spring pressure seats therein, locking the position of the frame 16 until the plunger 44*c* is again manually withdrawn.

To move the frame 18, which is connected to the frame mounts 32 of the hubs 12 and 14, the user unlocks the associated plunger locks 44 and pulls or pushes on the frame 18, which causes the puck 40 and the rear index plate 36 to rotate. For each hub, once the index plate 36 is rotated to a location where the plunger 44*c* associated therewith encounters one of the indexing slots 36*b*, the plunger 44*c* under spring pressure seats therein, locking the position of the frame 18 until the plunger 44*c* is again manually withdrawn.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A foldable sun cover mountable on a watersports tower of a boat, the sun cover comprising: a pair of frames connected to a pair of hubs mounted on opposite sides of the tower, each hub comprising a pair of movable mounts, each of the movable mounts being connected to one of the frames and independently movable to orient the frames each to a locked and deployed position in which each frame is locked in a substantially horizontal position so that each frame is substantially aligned with the other frame, with each hub including a pair of rotatable index plates, each index plate having at least one lock location thereon for receiving a spring loaded lock so that when the index plate is rotated so that when the lock location is aligned with the spring loaded lock, the index plate is locked against rotation.

2. A foldable sun cover mountable on a watersports tower of a boat, the sun cover comprising: a pair of frames connected to a pair of hubs mounted on opposite sides of the tower, each hub comprising a pair of movable mounts, each of the movable mounts being connected to one of the frames and independently movable to orient the frames each to a locked and deployed position in which each frame is locked in a substantially horizontal position so that each frame is substantially aligned with the other frame, wherein each hub comprises a rotatable drive member drivingly engaged with a first plate and a first movable mount, wherein rotation of the drive member directly rotates the first plate and the first movable mount; and a second movable mount directly connected to a second plate, the second plate being independently rotatable about the rotatable drive member.

3. A foldable sun cover mountable on a watersports tower of a boat, the sun cover comprising:

a pair of frames connected to a pair of hubs mounted on opposite sides of the tower, each hub comprising:

a rotatable drive member drivingly engaged with a first rotatable plate and a first movable mount connected to one of the frames, wherein rotation of the drive member directly rotates the first plate and the first movable mount;

a first lock surface located on the first plate and a first spring loaded lock operatively associated with the first plate such that when the first plate is rotated such that the first lock surface is aligned with the first spring loaded lock, the first lock engages the first lock surface to lock the first rotatable plate against rotation;

a second movable mount connected to the other of the frames and directly connected to a second plate, the second plate being independently rotatable about the rotatable drive member; and a second lock surface located on the second plate and a second spring loaded lock operatively associated with the second plate such that when the second plate is rotated such that the second lock surface is aligned with the second spring loaded lock, the lock engages the second lock surface to lock the second rotatable plate against rotation.

4. The foldable sun cover of claim 3, wherein each hub further comprises a base adjacent to the second plate and a mount adjacent to the base opposite the second plate, the base having an aperture through which a portion of the drive member rotatably extends so that a portion of the drive member is located between the base and the mount.

5. The foldable sun cover of claim 4, wherein the mount is configured to mount to the watersports tower, and the hub further comprises a plurality of compression springs located between the base and the second plate to enable the hub to flex.

6. A hub for rotatably mounting a pair of frame members, the hub comprising:

a rotatable drive member drivingly engaged with a first rotatable plate and a first movable mount connectable to one of the frame members, wherein rotation of the drive member directly rotates the first plate and the first movable mount;

a first lock surface located on the first plate and a first spring loaded lock operatively associated with the first plate such that when the first plate is rotated such that the first lock surface is aligned with the first spring loaded lock, the first lock engages the first lock surface to lock the first rotatable plate against rotation;

a second movable mount connectable to the other of the frame members and connected to a second plate, the second plate being independently rotatable about the rotatable drive member; and a second lock surface located on the second plate and a second spring loaded lock operatively associated with the second plate such that when the second plate is rotated such that the second lock surface is aligned with the second spring loaded lock, the lock engages the second lock surface to lock the second rotatable plate against rotation.

7. The hub of claim 6, wherein the hub further comprises a base adjacent to the second plate and a mount adjacent to the base opposite the second plate, the base having an aperture through which a portion of the drive member rotatably extends so that a portion of the drive member is located between the base and the mount.

8. The hub of claim 7, wherein the hub further comprises a plurality of compression springs located between the base and the second plate to enable the hub to flex.

* * * * *